US006705982B1

(12) United States Patent
Cote et al.

(10) Patent No.: US 6,705,982 B1
(45) Date of Patent: Mar. 16, 2004

(54) PRE-FOLD SWORD INSERTION DEVICE

(75) Inventors: Kevin Lauren Cote, Durham, NH (US); Lawrence E. Zagar, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 193 days.

(21) Appl. No.: 09/713,414

(22) Filed: Nov. 15, 2000

(51) Int. Cl.[7] ..... B31F 1/00

(52) U.S. Cl. ..... 493/447; 493/446; 493/424; 493/427; 493/340; 493/309; 493/320; 493/287; 493/175; 493/187; 493/163; 270/52.09; 270/52.27; 270/52.26; 270/52.29; 270/52.23

(58) Field of Search ..... 493/424, 427, 493/340, 309, 320, 287, 175, 187, 163, 446, 447; 83/678, 695, 33, 39, 934; 412/22, 2; 270/52.09, 52.27, 52.26, 52.29, 52.23

(56) References Cited

U.S. PATENT DOCUMENTS 3,722,877 A * 3/1973 Wetter ..... 270/52.23
3,743,273 A * 7/1973 Katz et al. ..... 270/37
3,762,697 A 10/1973 Bolza-Schuenemann ..... 270/6
3,897,051 A * 7/1975 Muller ..... 270/43
4,275,873 A * 6/1981 Rathert ..... 270/52.23
4,401,300 A * 8/1983 Morin ..... 270/52.23
4,729,282 A * 3/1988 Kasdorf ..... 271/302
4,910,941 A * 3/1990 Nagano et al. ..... 53/291
5,103,703 A * 4/1992 Littleton ..... 83/100
5,466,210 A * 11/1995 Wilcox ..... 493/309
5,758,871 A * 6/1998 Schlough ..... 270/52.27
5,938,243 A * 8/1999 De Santo ..... 283/34
6,017,027 A * 1/2000 Jaeger ..... 270/52.19
6,120,427 A * 9/2000 Haan et al. ..... 493/441
6,363,851 B1 * 4/2002 Gerhard et al. ..... 101/483
6,364,305 B1 * 4/2002 Sussmeier et al. ..... 270/52.09

FOREIGN PATENT DOCUMENTS

EP 0479067 1/1995 ..... B65H/39/105

* cited by examiner

*Primary Examiner*—Rinaldi I. Rada
*Assistant Examiner*—Brian Nash
(74) *Attorney, Agent, or Firm*—Davidson, Davidson & Kappel, LLC

(57) ABSTRACT

A folder includes a first cutting device for partially cutting a web of material, a former to fold the web of material, so as to form a folded web, a stationary signature opening device located between sides of the passing folded web, and a second cutting device located downstream from the former to cut the folded web into an at least one signature. A related collating device is also provided.

17 Claims, 6 Drawing Sheets

PRE-FOLD SWORD INSERTION DEVICE

BACKGROUND OF THE INVENTION

1. Field of the Invention

The present invention relates generally to folders of printing presses and more particularly to a device for folding and transporting signatures.

2. Background Information

Web printing presses print a continuous web of material, such as paper. In a folder of the printing press, the continuous web is folded by a former and cut into signatures. The signatures then may be collated in a collating device.

One way to open folded signatures to permit collation or transport is with a lap, i.e. an overlapping area on the folded signature. A device opens the signature using the lap and then trims the lap away. Trimming the lap generates significant waste and adds a step to the printing process, making the process less efficient and slower.

Another way to open folded signature is with a gripper. To open the signature, a gripping device seizes and then opens the signature. However, the gripping device can cause damage to the signature.

Thus, the need to open the signature, for example to deposit the signature on a saddle, results in significant fault generation in the bindery. The generation of significant faults requires the addition of multiple diagnostic parts to conventional saddle collation machines, which results in increased costs and reductions in reliability and productivity.

U.S. Pat. No. 3,762,697 purports to disclose a delivery apparatus for use with a folding apparatus of web-fed rotary printing machines. The paper webs are cut to copy length by cutting cylinders and then transferred to the folding blade cylinders and folded in the folding rollers. Thereafter, using the fans, the folded products are delivered to conveyor belts.

The device of the '697 patent does not appear to provide for opening the signatures and the apparatus uses a complicated folding apparatus to fold the signatures. The fan arrangement and folding apparatus subject the device to time consuming and difficult repair and do not permit collation.

European Patent No. EP 0 479 067 B1 purports to disclose a collator for collecting and depositing signatures, apparently having a circulating first receiving device, which is constructed as an oblong conveyor with a plurality of receiving portions open towards the outside onto which the separate signatures are inserted and from which the signatures are combined to form book blocks. The book blocks are delivered to a first receiving device, which then delivers the signatures to a second receiving device, where the book blocks are removed with the aid of rear stops of adjustable height. The second receiving device then delivers the book blocks to the transport device.

With European Patent No. EP 0 479 067 B1 the signatures appear to have to enter the book blocks in the order that the signatures will be assembled, as no device is present for opening the signatures and inserting other signatures. Moreover, the device possesses a complicated arrangement of moving parts, which may make repair and servicing time consuming and expensive.

BRIEF SUMMARY OF THE INVENTION

An object of the present invention is to provide for a device for eliminating or simplifying the opening or collating of a signature in a post-folding process.

The present invention provides a folder comprising:

a first cutting device to partially cut a web of material;

a former to fold the web of material, so as to form a folded web;

a stationary signature opening device located between sides of the passing folded web; and a second cutting device located downstream from the former to sever the folded web into an at least one signature.

With the stationary opening device, e.g. a stationary sword, of the present invention, the need to open a signature with a separate device in a post-folding process is eliminated. The stationary sword can provide the opening for the signature. Thus, the present invention eliminates the need for a signature lap to open a folded signature, which results in a more economical and efficient printing process. Moreover, the present invention eliminates the need for grippers and thus, reduces damage to the signatures. The speed of the entire collation process may also be increased.

The cutting devices preferably are pairs of cutting cylinders.

Preferably, the former of the pre-fold insertion device laterally aligns the plurality of partial cuts in the web. The lateral alignment advantageously permits the second pair of cut cylinders to sever a signature from the web by cutting the web in exactly the locations that the first pair of cut cylinders did not cut.

The second pair of cut cylinders of the pre-fold insertion device may further provide a recess to allow the stationary sword to pass through. The recess provides the advantage of allowing the stationary sword to project through the second pair of cut cylinders, which allows the second pair of cut cylinders to sever the signature without contacting or damaging the stationary sword.

The stationary sword preferably increases in thickness downstream from the second pair of cut cylinders and in so doing spreads apart the edges of a signature, so as to open the signature. Advantageously, the increase in thickness allows the signature to be placed on the moving swords without the need for a gripper or other device to open the signature.

Preferably, the stationary sword has an aperture that allows a plurality of moving wedge swords to pass through the stationary sword. The aperture advantageously permits the moving wedge swords to pass through the stationary sword and in so doing pull the signatures off the stationary sword.

The present invention may further include a sword conveyor to transport a plurality of moving swords or moving wedge swords. The sword conveyor provides the advantage of allowing the signatures on the swords to proceed to additional pre-fold sword insertion devices, where the swords receive additional signatures, or continue to other steps in the collation process.

Preferably, the sword conveyor moves in a direction perpendicular to the direction of the stream of signatures.

The sword conveyor of the present invention may also move at about a 45 degree angle to the direction of the stream of signatures. Advantageously, the motion of the sword conveyor reduces the relative velocity between the signature and the sword conveyor, thus, the present invention may function at higher speeds without damaging the signature.

A collating devices with two folders according to the present invention is also provided.

BRIEF DESCRIPTION OF THE DRAWINGS

A preferred embodiment of the present invention is described below by reference to the following drawings, in which.

DETAILED DESCRIPTION

Figure 1:
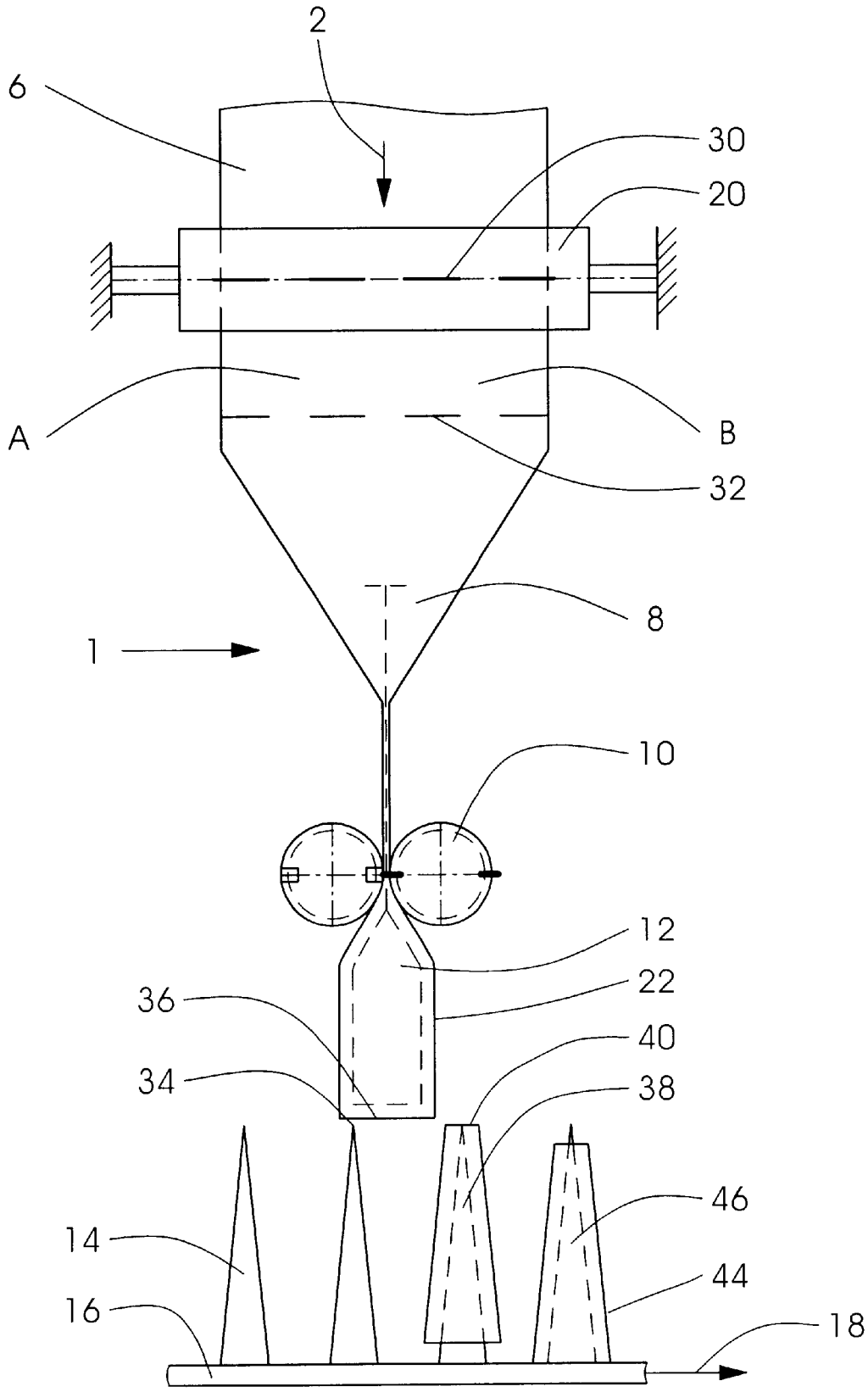
FIG. 1 shows a front view of the folder, which includes a plurality of partial cuts.

FIG. 1 shows a front view of a folder 1. A first pair of cut cylinders 20 cuts a web 6 traveling in a downstream direction 2 with a plurality of knives 30 disposed along the outer surface of at least one of the first pair of cut cylinders 20. Each of the knives 30 making one of a plurality of partial cuts 32 in the web 6. The web 6, which has a side A and a side B, then passes over a former 8, which folds the web 6 so that sides A and B meet and partial cuts 32 laterally align. Located in the "shadow" of the former 8, i.e., the area where the former 8 displaces the web 6 and the sides A and B meet, is a stationary sword 12, which extends to the former as indicated by the dotted lines in FIG. 1. The web 6 exits the former 8 with the stationary sword 12 located in the web 6 between sides A and Band aligned with the partial cuts 32. The web 6 continues past a second pair of cut cylinders 10, which severs the web 6 into an at least one signature 22.

Downstream from the second pair of cut cylinders 10, the stationary sword 12 increases in thickness and spreads open the edges of the signature 22 opposite the fold. By increasing in thickness, the stationary sword 12 opens the signature 22, so that the signature 22 fits over one of a plurality of moving swords 14. The moving swords 14 are timed so that a leading side 36 of the signature 22 does not contact the top of a first moving sword 34. While the signature 22 descends, a second signature 40 settles on a second moving sword 38 and a third signature 44 comes to rest about a third moving sword 46. A sword conveyor 16 transports the moving swords 14, 34, 38, 46 in a second direction 18, which is perpendicular to the direction of descent of the signature 22.

Figure 2:
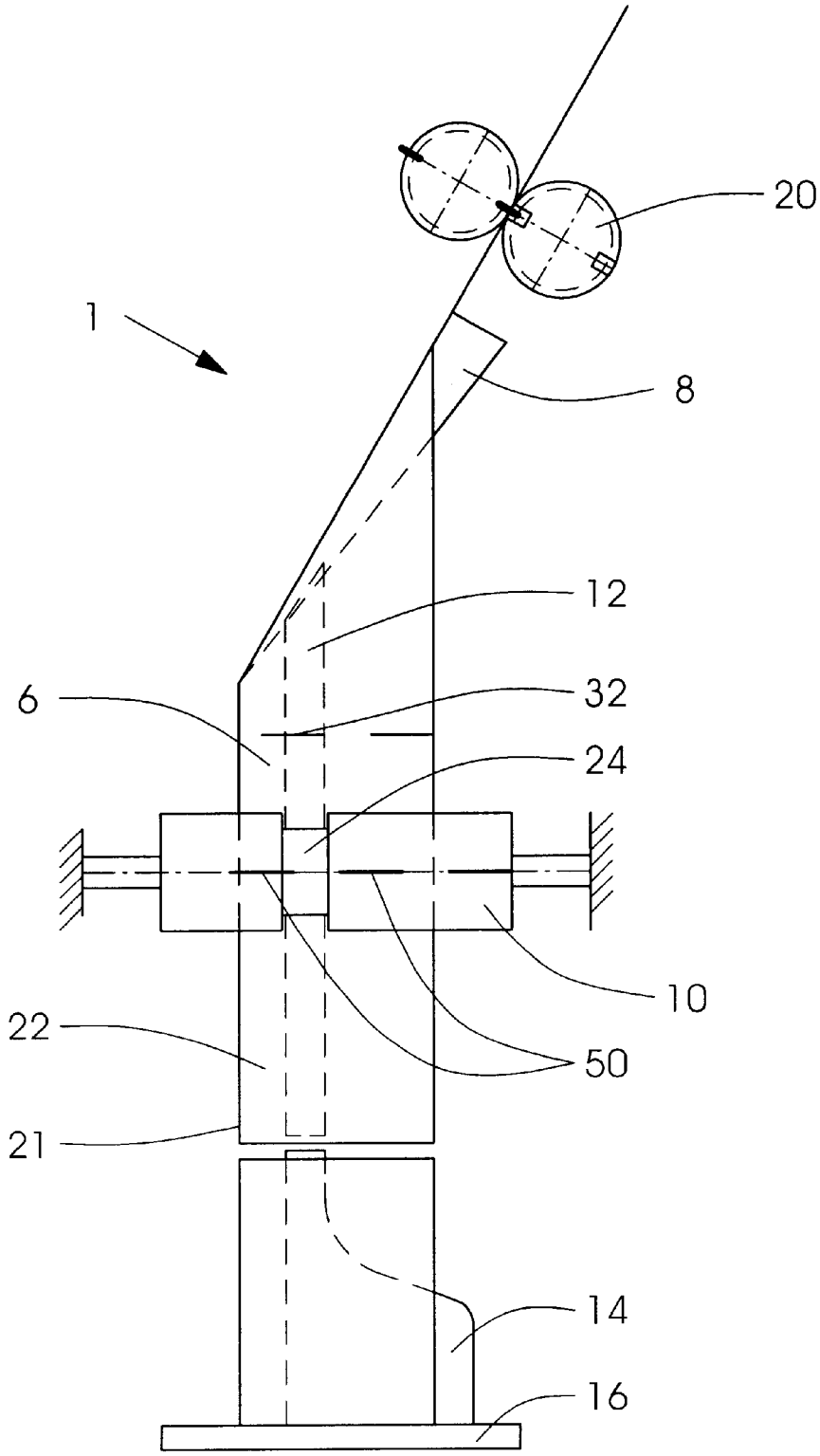
FIG. 2 shows a side view of the folder, which includes the partial cuts.

FIG. 2 shows a side view of the folder 1, and also shows the partial cuts 32 in web 6. The side view shows the first pair of cut cylinders 20 in relation to the web 6, the former 8, and the stationary sword 12. After folding of web 6 to form a folded edge 21, the former 8 positions the partial cuts 32 of the web 6 in alignment with the stationary sword 12 so that the partial cuts 32 are laterally aligned. The lateral alignment allows the second pair of cut cylinders 10 to sever the signature 22 from the web 6 by cutting the web 6 in exactly the locations that the first pair of cut cylinders 20 did not. To effect the cut, the second pair of cut cylinders 10 uses a plurality of second knives 50 disposed along the outer surfaces of at least one of the second pair of cut cylinders 10. Since the former 8 aligns the stationary sword 12 with the partial cuts 32, the stationary sword 12 does not interfere with the second pair of cut cylinders 10. A recess 24 allows the stationary sword 12 to project through the second pair of cut cylinders 10 and provides a clearance for the stationary sword 12. The recess 24 also allows the stationary sword 12 to project from the underside of the former 8 through the second pair of cut cylinders 10.

Figure 3:
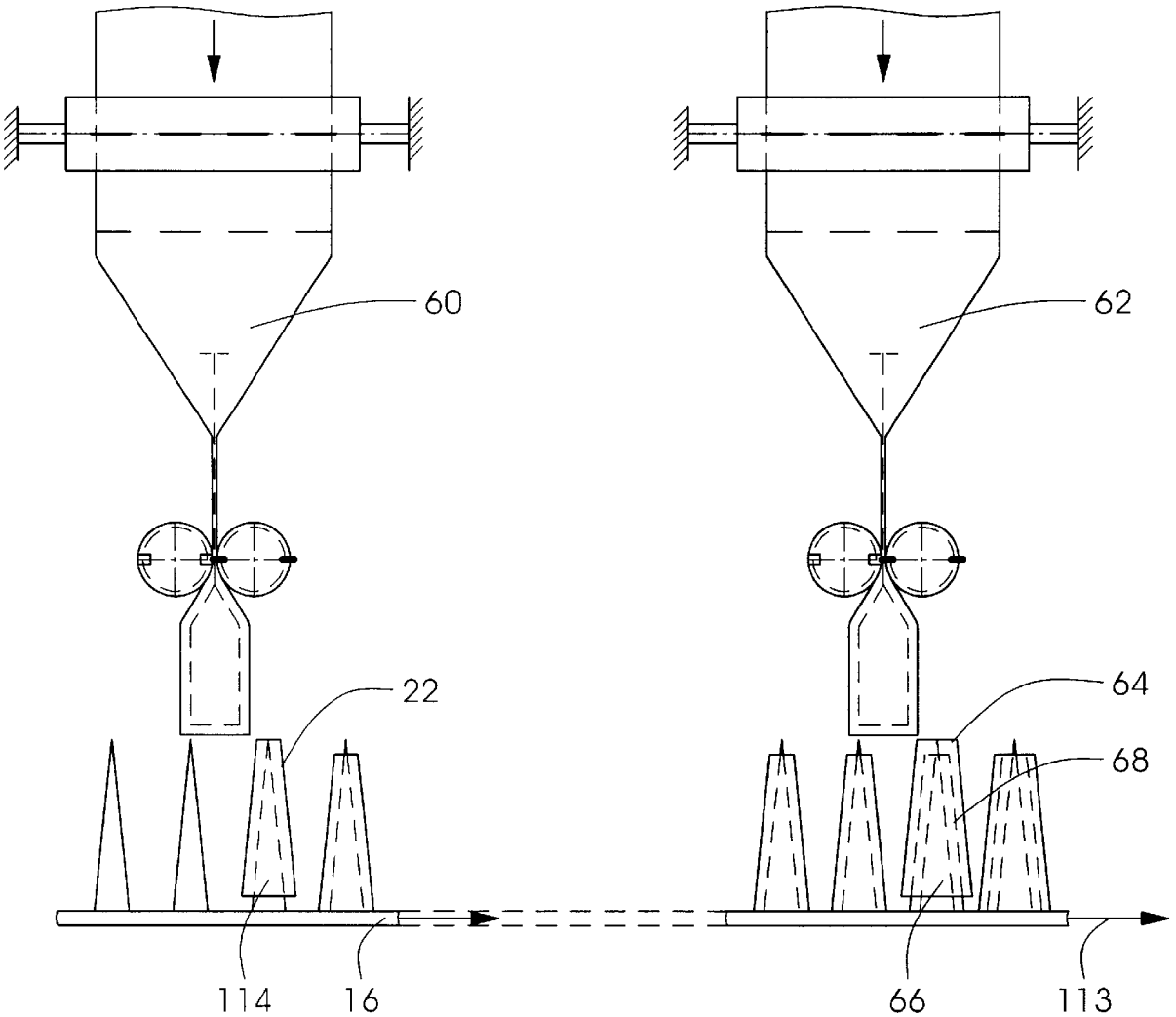
FIG. 3 shows a first embodiment of the pre-fold sword insertion invention, which includes a first folder and a second folder.

FIG. 3 shows an embodiment of the present invention for collation, which includes a first folder 60 and a second folder 62, similar to the folders shown in FIGS. 1 and 2. The first folder 60 deposits the signature 22 on a first collating sword 114, while the second folder 62 deposits another folded signature 64 on a second collating sword 66. The other folded signature 64 thus rests over a second folded signature 68, which the first folder 60 deposited earlier in the collation process. The sword conveyor 16 then transports the collating swords in direction 113, so that first collating sword 114 moves to the second folder 62 and the second collating sword 66 to another folder or to some other destination.

Figure 4:
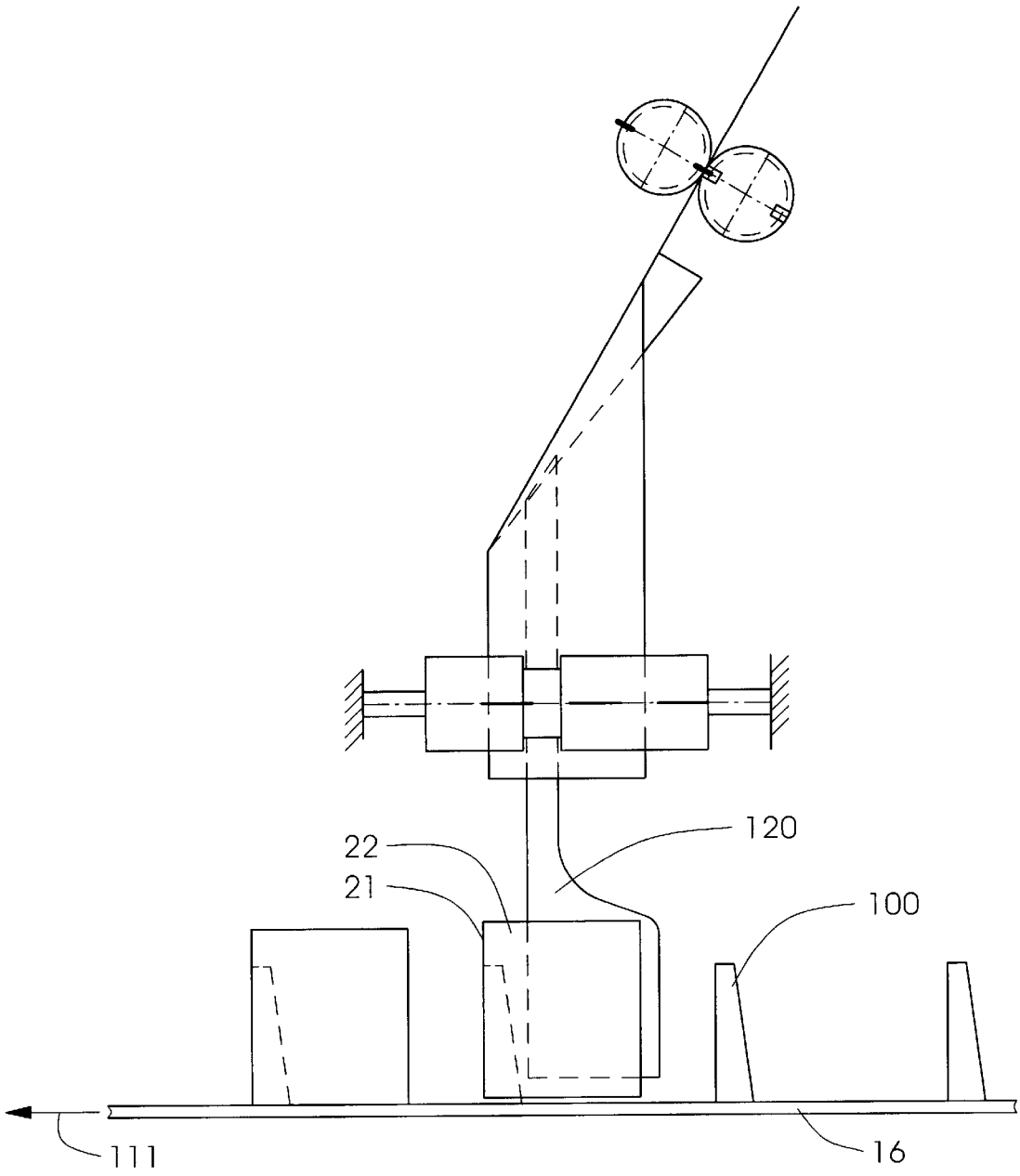
FIG. 4 shows a second embodiment of the pre-fold sword insertion invention, which includes an open stationary sword.

FIG. 4 shows a second embodiment of the pre-fold sword insertion invention, which includes an forked stationary sword 120. The forked stationary sword 120 has an aperture between two forked sections in the lower portion, which allows a plurality of wedge swords 100 to pass through in direction 111. A folded edge 22 of signature 21 thus interacts with wedge swords 100 to move the signatures. The shape of the forked stationary sword 120 moves the sides of signature 22 to the outside of the open stationary sword 120. The wedge swords 100, which are driven by the sword conveyor 16, pass through the aperture between the forks of the stationary sword 120 and in so doing contact the inside of the signature 22 to pull the signature 22 off the stationary sword 120. The wedge swords 100 then transport the signature 22 downstream to another stationary sword or some other destination.

Figure 5:
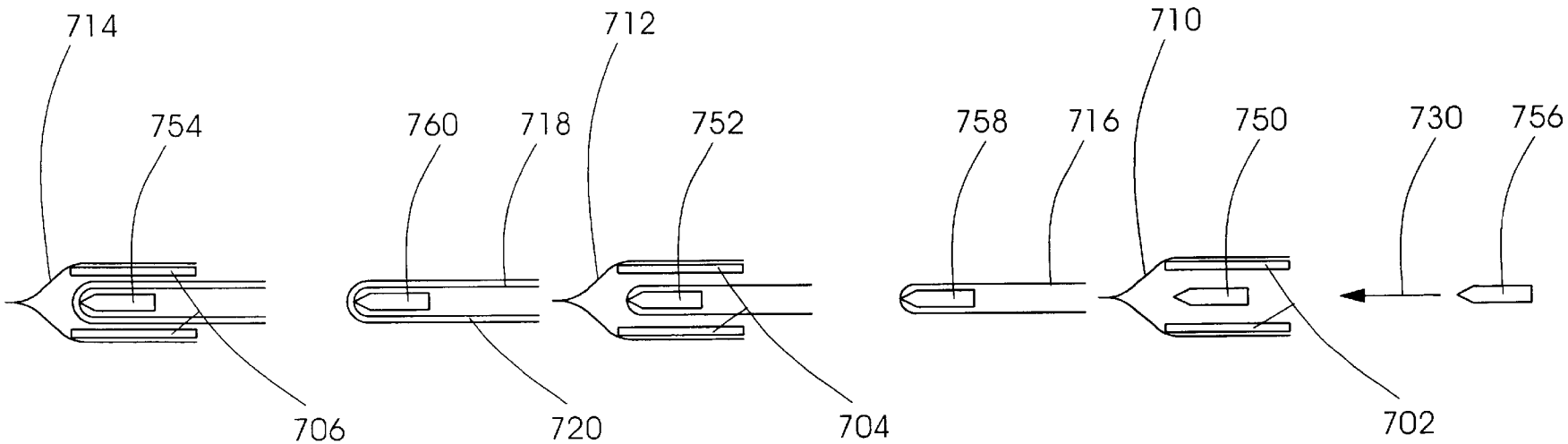
FIG. 5 shows a top view of three open stationary swords and six signatures.

FIG. 5 shows a top view of a collation device with three forked stationary swords 702, 704, 706, similar to those shown in FIG. 4, and six signatures 710, 712, 714, 716, 718, 720. A first wedge sword 750, similar to sword 100 in FIG. 4, passes through the aperture of the first forked stationary sword 702, thus, contacting the inside of the first partially collated signature 710 and pulling the first partially collated signature 710 off the first forked stationary sword 702. While the first wedge sword 750 passes through the aperture, a second wedge sword 752 passes through the aperture of the second forked stationary sword 704 and pulls the second partially collated signature 712 off the second forked stationary sword 704. At the same time, a third wedge sword 754 passes through the third forked stationary sword 706 to pick up the third partially collated signature 714.

Also shown are a fourth wedge sword 756, a fifth wedge sword 758, and a sixth wedge sword 760 each progressing in a direction 730 consistent with the collation process. The fifth wedge sword 758 carries the fourth signature 716, while the sixth wedge sword 760 carries the sixth partially collated signature 718 and the seventh partially collated signature 720. The fourth and sixth signatures 716, 718 have been pulled off the first forked stationary sword 702 and the seventh partially collated signature 720 has been pulled off the second forked stationary sword 704.

Figure 6:
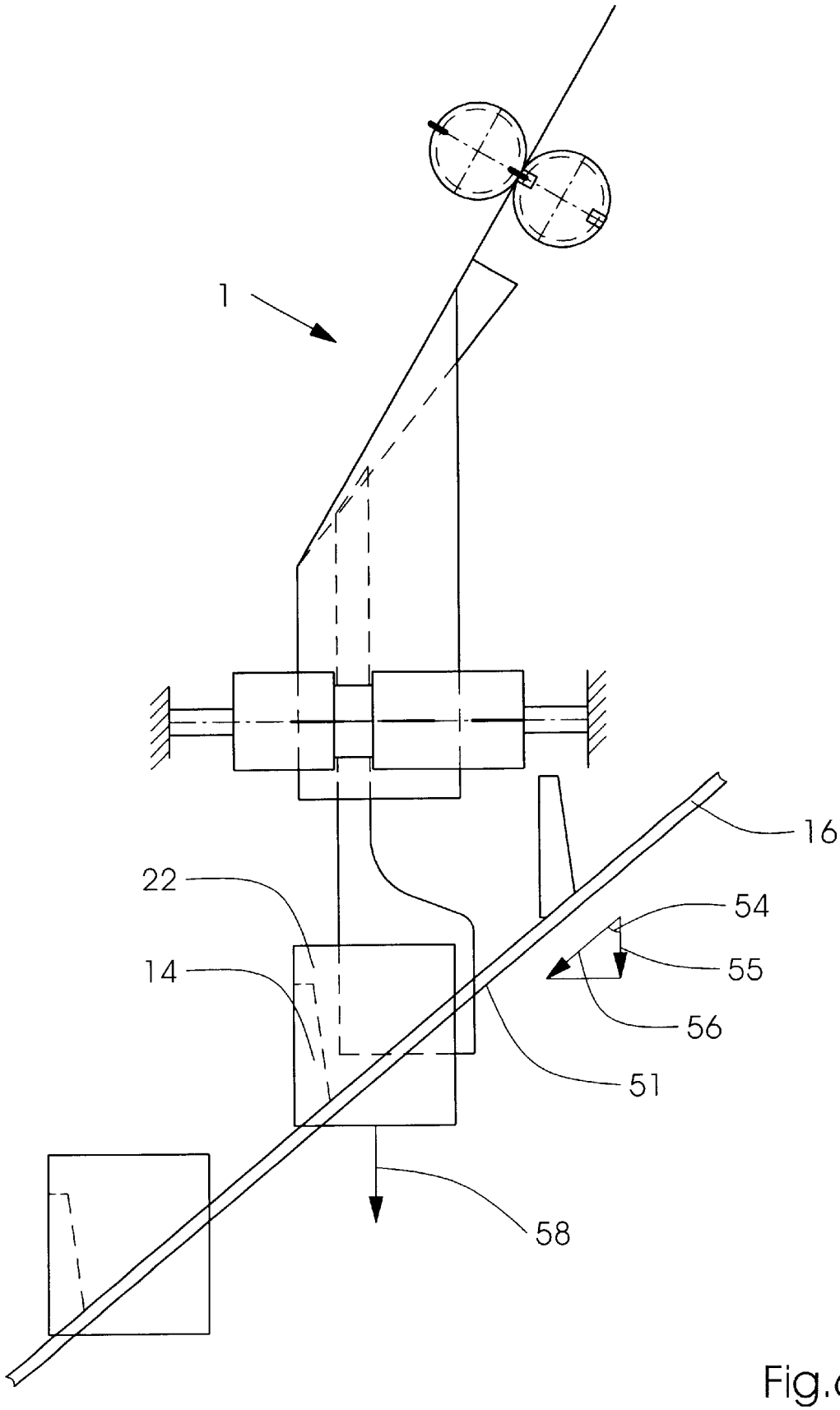
FIG. 6 shows a third embodiment of the pre-fold sword insertion invention, which includes the sword conveyor.

FIG. 6 shows a third embodiment of the pre-fold sword insertion invention, which includes the sword conveyor 16. The folder 1, similar to the one shown in FIG. 4, deposits the signature 22 on one of the moving swords 14 of the sword conveyor 16, which passes through a forked stationary sword. The sword conveyor 16 travels in a non-perpendicular direction 56 at about 45 degrees to a descending direction 58 of the signature 22. An angle 54 defines the deviation of the non-perpendicular direction 56 from the descending direction 58 of the signature 22. As such, the angle 54 provides a component of velocity 55 to the signature 22, which facilitates the transfer of the signature 22 to the sword conveyor 16.

"Sword" as defined herein is a three-dimensional object with one side thinner than either of the other two sides, and can be of any shape, material or size.

The orientation of the former board can be different from that shown in the embodiments described above. For example, the folded web could exit horizontally instead of vertically. Thus the device for example in FIG. 6 could be rotated 90 degrees clockwise so that the sword conveyor would travel towards the upper left corner of the page (instead of the lower left as shown). Gravity thus could aid in keeping the signatures on the moving swords.

What is claimed is:

1. A folder comprising:

a first cutting device for partially cutting a moving web of material;

a former to fold the web of material, so as to form a moving folded web;

a stationary signature opening device located at least partially in an area where the former displaces the web and downstream of the former so as to be located between sides of the moving folded web; and a second cutting device located downstream from the former to cut the moving folded web into an at least one signature.

2. The folder as recited in claim 1 wherein the first cutting device includes a pair of cutting cylinders.

3. The folder as recited in claim 1 wherein the former laterally aligns a plurality of partial cuts in the web.

4. The folder as recited in claim 1 wherein the second cutting device has a recess through which the stationary signature opening device passes.

5. The folder as recited in claim 1 wherein the stationary signature opening device is a sword.

6. The folder as recited in claim 1 wherein the stationary signature opening device increases in thickness downstream from the second cutting device.

7. The folder as recited in claim 1 wherein the stationary signature opening device spreads apart the sides of the at least one signature, so as to open the at least one signature.

8. The folder as recited in claim 1 wherein the stationary sword is forked so as to have an aperture.

9. The folder as recited in claim 8 further comprising a plurality of wedge swords to pass through the aperture, so as to receive the at least one signature.

10. The folder as recited in claim 9 further comprising a sword conveyor to transport the wedge swords.

11. The folder as recited in claim 10 wherein the sword conveyor moves in a direction perpendicular to the direction of movement of the at least one signature.

12. The folder as recited in claim 10 wherein the sword conveyor moves at an angle of between 30 and 60 degrees to a direction of movement of the at least one signature.

13. The folder as recited in claim 1 further comprising a plurality of moving swords to receive the at least one signature.

14. The folder as recited in claim 13 further comprising a sword conveyor to transport the moving swords.

15. The folder as recited in claim 12 wherein the sword conveyor moves in a direction perpendicular to the direction of the at least one signature.

16. The folder as recited in claim 12 wherein the sword conveyor moves at about a 45 degree angle to the direction of the at least one signature.

17. A collating device comprising:

a first folder having a first cutting device for partially cutting a web of material, a former to fold the web of material, a stationary signature opening device located between folded sides of the web, the passing by the stationary signature opening device, and a second cutting device located downstream from the former to cut the folded web into an at least one first signature;

a conveying device to convey the at least one first signature from the first folder; and a second folder having a third cutting device for partially cutting a second web of material, a second former to fold the second web of material, a second stationary signature opening device located between folded sides of the second web, and a fourth cutting device located downstream from the former to cut the folded web into an at least one second signature, the at least one second signature being deposited over the at least one first signature on the conveying device.

* * * * *

UNITED STATES PATENT AND TRADEMARK OFFICE

CERTIFICATE OF CORRECTION

PATENT NO. : 6,705,982 B1
DATED : March 16, 2004
INVENTOR(S) : Cote et al.

It is certified that error appears in the above-identified patent and that said Letters Patent is hereby corrected as shown below:

Column 6,
Line 5, "the passing by the stationary signature opening device" should be deleted and then replaced with -- the web passing by the stationary signature opening device --.

Signed and Sealed this

Twenty-fifth Day of May, 2004

JON W. DUDAS
*Acting Director of the United States Patent and Trademark Office*